US009151045B2

(12) United States Patent
Huang

(10) Patent No.: US 9,151,045 B2
(45) Date of Patent: Oct. 6, 2015

(54) PARTITION STRUCTURE HAVING ENGAGING ASSEMBLY

(71) Applicant: Cityneon Displays (Taiwan) Co., Ltd., Taipei (TW)

(72) Inventor: Che-Hsiung Huang, Taipei (TW)

(73) Assignee: CITYNEON DISPLAYS (TAIWAN) CO., LTD., Taipei (TW)

( * ) Notice: Subject to any disclaimer, the term of this patent is extended or adjusted under 35 U.S.C. 154(b) by 0 days.

(21) Appl. No.: 13/752,399

(22) Filed: Jan. 29, 2013

(65) Prior Publication Data

US 2014/0208673 A1 Jul. 31, 2014

(51) Int. Cl.

| | |
|---|---|
| ***E04H 1/00*** | (2006.01) |
| ***E04B 2/74*** | (2006.01) |
| *E04B 1/61* | (2006.01) |

(52) U.S. Cl.

CPC ..... *E04B 2/7401* (2013.01); *E04B 2/7425* (2013.01); *E04B 1/6141* (2013.01); *E04B 2001/6191* (2013.01); *E04B 2001/6195* (2013.01); *E04B 2002/7446* (2013.01)

(58) Field of Classification Search

CPC ... E04B 2/7401; E04B 2/7425; E04B 1/6141; E04B 2001/6191; E04B 2001/6195; E04B 2002/7446

USPC ..... 52/238.1, 239, 241, 242, 582.1, 582.2, 52/220.7, 281; 403/242, 254

See application file for complete search history.

(56) References Cited

U.S. PATENT DOCUMENTS

| | | | | |
|---|---|---|---|---|
| 3,312,025 | A * | 4/1967 | Deakins | 52/239 |
| 5,058,347 | A * | 10/1991 | Schuelke et al. | 52/239 |
| 5,176,462 | A * | 1/1993 | Chen | 403/252 |
| 5,592,794 | A * | 1/1997 | Tundaun | 52/220.7 |
| 6,351,916 | B2 * | 3/2002 | Militzer | 52/239 |
| 6,612,078 | B2 * | 9/2003 | Hawang | 52/36.5 |
| 6,711,871 | B2 * | 3/2004 | Beirise et al. | 52/782.1 |
| 6,729,085 | B2 * | 5/2004 | Newhouse et al. | 52/239 |
| 6,854,234 | B2 * | 2/2005 | Gimpel et al. | 52/586.2 |
| 7,984,598 | B2 * | 7/2011 | Gosling et al. | 52/582.2 |
| 8,756,893 | B2 * | 6/2014 | Gosling et al. | 52/582.2 |
| 2009/0293406 | A1 * | 12/2009 | Gosling et al. | 52/582.1 |

FOREIGN PATENT DOCUMENTS

| | | | |
|---|---|---|---|
| JP | 2007107322 | A | 4/2007 |
| JP | 2011122295 | A | 6/2011 |
| KR | 200388088 | Y1 | 6/2005 |
| TW | 301326 | | 3/1997 |

* cited by examiner

*Primary Examiner* — Mark Wendell

(74) *Attorney, Agent, or Firm* — Chun-Ming Shih; HDLS IPR Services

(57) ABSTRACT

A partition structure includes two partition members each of which has two edges formed on a side and an engaging assembly including a first engaging member, a second engaging member and at least one locking member. The first engaging member has two first L-shaped wing portions extending from two sides thereof and a convex portion formed on a middle and having at least one opening slot. The second engaging member has two second L-shaped wing portions extending from two sides thereof and a concave portion formed on a middle. The locking member is fixed to the concave portion. The two first L-shaped wing portions and the two second L-shaped wing portions correspondingly overlap each of the two edges, respectively, the convex portion and the concave portion are engaged with each other, and the locking member is correspondingly engaged with the opening slot.

8 Claims, 10 Drawing Sheets

PARTITION STRUCTURE HAVING ENGAGING ASSEMBLY

BACKGROUND OF THE INVENTION

1. Field of the Invention

The present invention relates to a partition structure, in particular, a partition structure having an engaging assembly.

2. Description of Prior Art

An assembling type partition structure primarily uses partitions to form a space. The space is an exhibition zone, personal zone or private zone. A traditional assembling type partition structure, such as TWM 301326, entitled "QUICK COMPARTMENT COMBINATIONS CONSTRUCTED," primarily comprises a plurality of partitions, column bodies and butting assemblies disposed above the partitions. The butting assembly includes male and female butting members. The male and female butting members are fixed on the partitions or the column bodies, respectively, such that each of the partitions and each of the column bodies are engaged with each other via the male and female butting members, so as to form a separated space.

However, the male butting member has a convex portion, the female butting member has a concave portion, and the engagement of each of the partitions and each of the column bodies is achieved by the engagement of the convex portion of the male butting member and the concave portion of the female butting member, such that the contact between the partition and the column body is not stable enough, and the positioning between the partitions is not reliable enough. Further, the partitions easily vibrate while being inadvertently crashed or pushed by users, such that the assembling type partition structure is disassembled, so as to generate danger.

In view of this, it is an improved target for endeavor of Applicant to solve the above-mentioned problems of the prior art by hard research and application of doctrines.

SUMMARY OF THE INVENTION

An objective of the present invention is to provide a partition structure having an engaging assembly. The engaging assembly is used to much more conveniently and quickly assemble each of partition members, such that the partition structure has advantages of convenient construction, quick assembly and stable structure.

In order to achieve the above-mentioned objective, the present invention provides a partition structure having an engaging assembly, comprising:

two partition members, each of the partition members having two edges on a side thereof; and an engaging assembly including a first engaging member, a second engaging member and at least one locking member, the first engaging member having two first L-shaped wing portions extending from two sides thereof and a convex portion formed on a middle thereof, the convex portion having at least one opening slot, the second engaging member having two second L-shaped wing portions extending from two sides thereof and a concave portion formed on a middle thereof, the locking member being fixed to the concave portion;

wherein the first engaging member is fixed to one of the partition members, the second engaging member is fixed to the other one of the partition members, the two first L-shaped wing portions and the two second L-shaped wing portions correspondingly overlap the two edges of each of the partition members, respectively, the convex portion and the concave portion are engaged with each other, and the locking member is correspondingly engaged with the opening slot.

Alternatively, in order to achieve the above-mentioned objective, the present invention provides a partition structure having an engaging assembly, comprising:

two partition members, each of the partition members having two edges on a side thereof;

a column body having at least two lateral surfaces formed on a periphery thereof;

an engaging assembly including a first engaging member, a second engaging member and at least one locking member, the first engaging member having two first L-shaped wing portions extending from two sides thereof and a convex portion formed on a middle thereof, the convex portion having at least one opening slot, the second engaging member having two second L-shaped wing portions extending from two sides thereof and a concave portion formed on a middle thereof, the locking member being fixed to the concave portion; and a butting assembly including a first butting member, a second butting member and at least one auxiliary locking member, the first butting member having a projection portion formed on a middle thereof, the projection portion having at least one penetrating slot, the second butting member having a cavity portion formed on a middle thereof, the auxiliary locking member being fixed to the cavity portion;

wherein the first engaging member is fixed to one of the partition members, the second engaging member is fixed to the other one of the partition members, the two first L-shaped wing portions and the two second L-shaped wing portions correspondingly overlap the two edges of each of the partition members, respectively, the first butting member and the second butting member are fixed to each of the lateral surfaces, respectively, the convex portion and the cavity portion are engaged with each other, the auxiliary locking member is correspondingly engaged with the opening slot, the projection portion and the concave portion are engaged with each other, the locking member is correspondingly engaged with the penetrating slot.

DETAILED DESCRIPTION OF THE INVENTION

Figure 1:
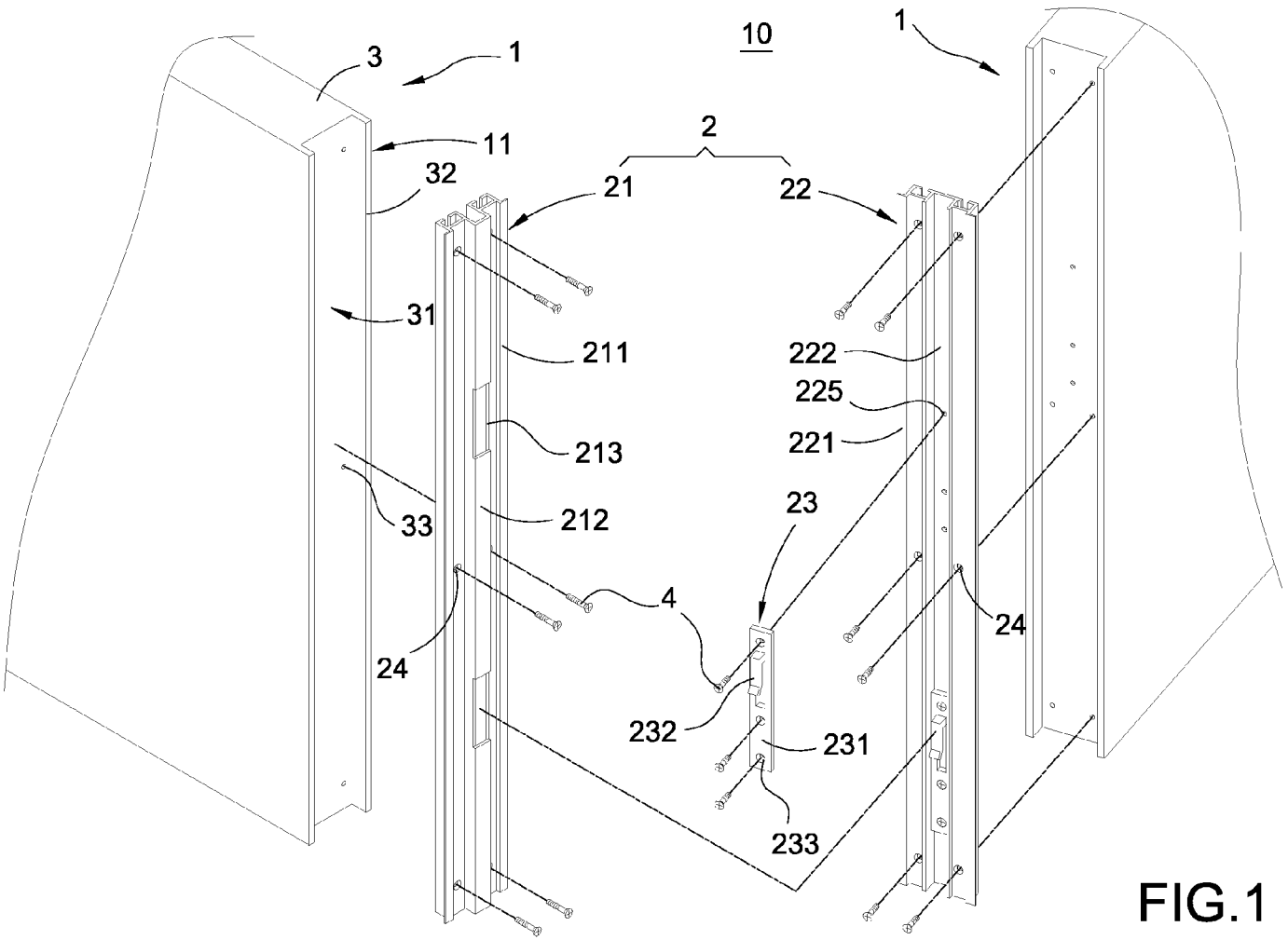
FIG. 1 is a perspective explosion view of a partition structure according to a first embodiment of the present invention.
Figure 2:
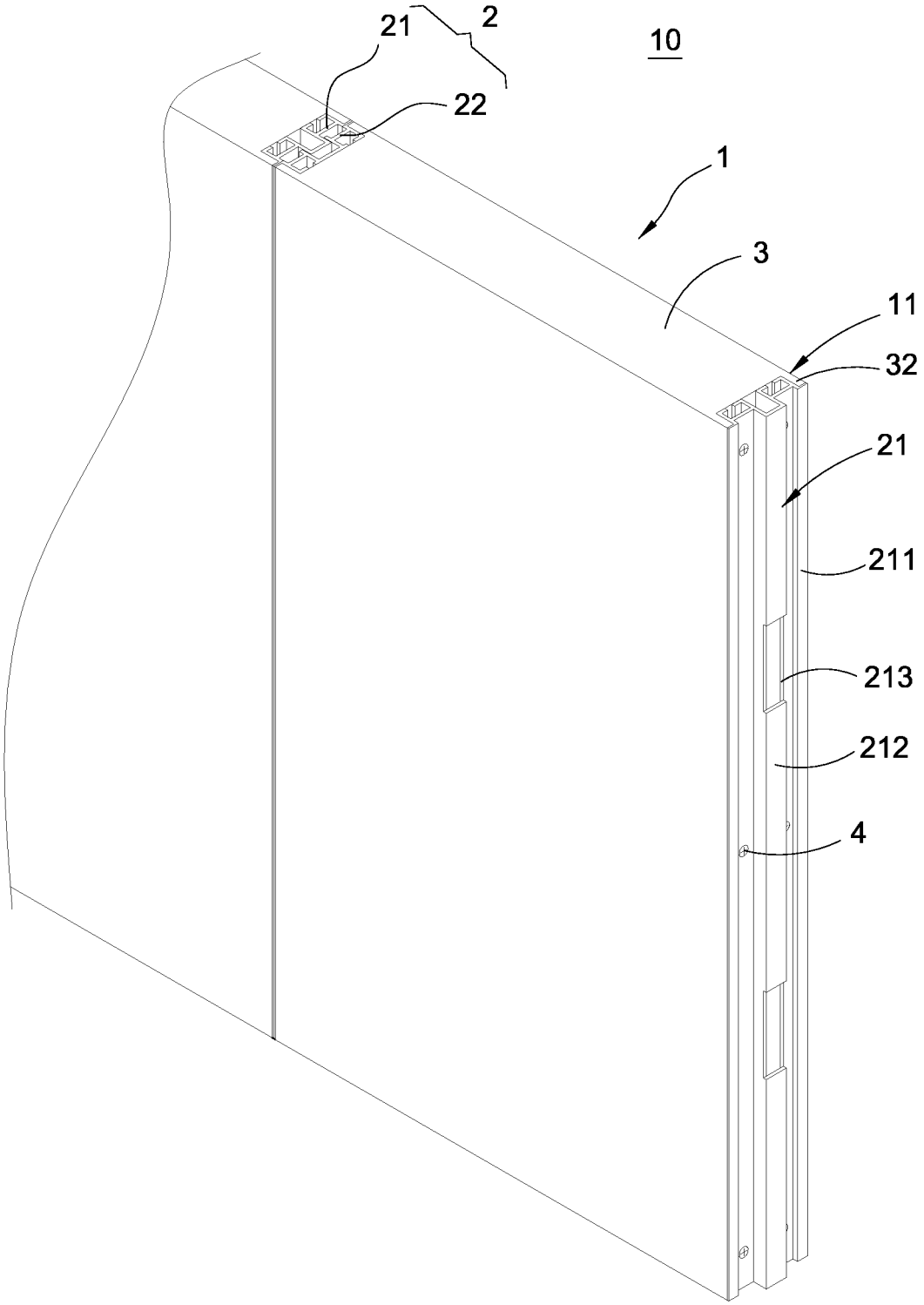
FIG. 2 is a perspective assembly view of the partition structure according to the first embodiment of the present invention.

The detailed description and the technical contents of the present invention are illustrated with the accompanied drawings as follows. The accompanied drawings merely provide reference and description instead of a limit to the present invention.

Please to FIGS. 1-4, the present invention provides a partition structure having an engaging assembly. The partition structure 10 primarily comprises two partition members 1 and an engaging assembly 2.

Each of the partition members 1 has two edges 11 formed on a side thereof. The detailed description is as follows. Each of the partition members 1 is a solid board 3. The solid board 3 has a concave segment 31 formed on a lateral surface thereof and two convex bars 32 formed with respect to two sides of the concave segment 31. The two convex bars 32 form two edges 11. In addition, the solid board 3 has a plurality of perforating holes 33.

The engaging assembly 2 includes a first engaging member 21, a second engaging member 22 and at least one locking member 23. The first engaging member 21 has two first L-shaped wing portions 211 extending from two sides thereof and a convex portion 212 formed on a middle thereof. The convex portion 212 has at least one opening slot 213. The second engaging member 22 has two second L-shaped wing portions extending from two sides thereof 221 and a concave portion 222 formed on a middle thereof. The locking member 23 is fixed to the concave portion 222.

Substantially, the first engaging member 21 is fixed to one of the partition members 1, the second engaging member 22 is fixed to the other one of the partition members 1, the two first L-shaped wing portions 211 and the two second L-shaped wing portions 221 correspondingly overlap each of the two edges 11, respectively, the convex portion 212 and the concave portion 222 are engaged with each other, and the locking member 23 is correspondingly engaged with the opening slot 213.

Further description is as follows. The convex portion 212 is a U-shaped board protruded from the middle of the first engaging member 21. The concave portion 222 is a U-shaped slot recessed from the middle of the second engaging member 22. The first engaging member 21 and the second engaging member 22 are accommodated in each of the concave segments 31, respectively. The first engaging member 21 and the second engaging member 22 have a plurality of via holes 24, respectively. In addition, the second engaging member 22 has a plurality of orifice holes 225 formed on the concave portion 222.

The locking member 23 has a main body 231 and a barb 232 extending from the main body 231. The barb 232 is inserted in the opening slot 213 and engaged to the convex portion 212 with each other. The main body 231 has a plurality of through holes 233.

The partition structure of the present invention further comprises a plurality of fastening members 4. Each of the fastening members 4 is inserted in and fixed to each of the via holes 24 and each of the perforating holes 33, respectively, such that the first engaging member 21 and the second engaging member 22 are fixed to each of the partition members 1, respectively.

The partition structure of the present invention further comprises a plurality of fastening members 4. Each of the fastening members 4 is inserted in and fixed to each of the through holes 233 and each of the orifice holes 225, respectively, such that the locking member 23 is fixed to the concave portion 222.

The partition structure of the present invention further comprises a latch mechanism 7. The latch mechanism 7 comprises a first latch member 71 and a second latch member 72 correspondingly engaged with the first latch member 71. The first latch member 71 is fixed to one of the partition members 1. The second latch member 72 is fixed to the other one of the partition members 1.

Figure 3A:
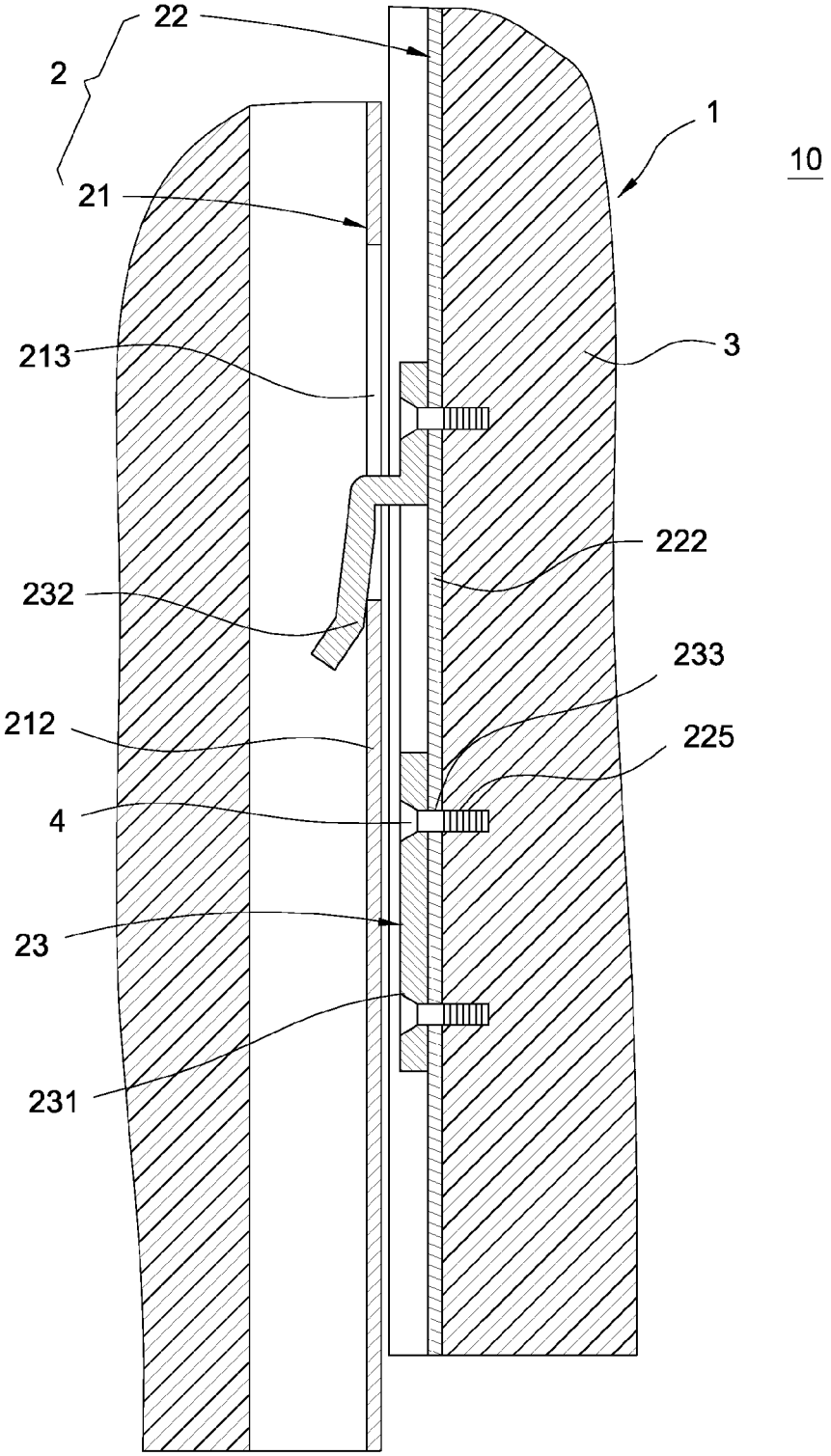
FIGS. 3A and 3B are schematically sectional views of the partition structure according to the first embodiment of the present invention.
Figure 3B:
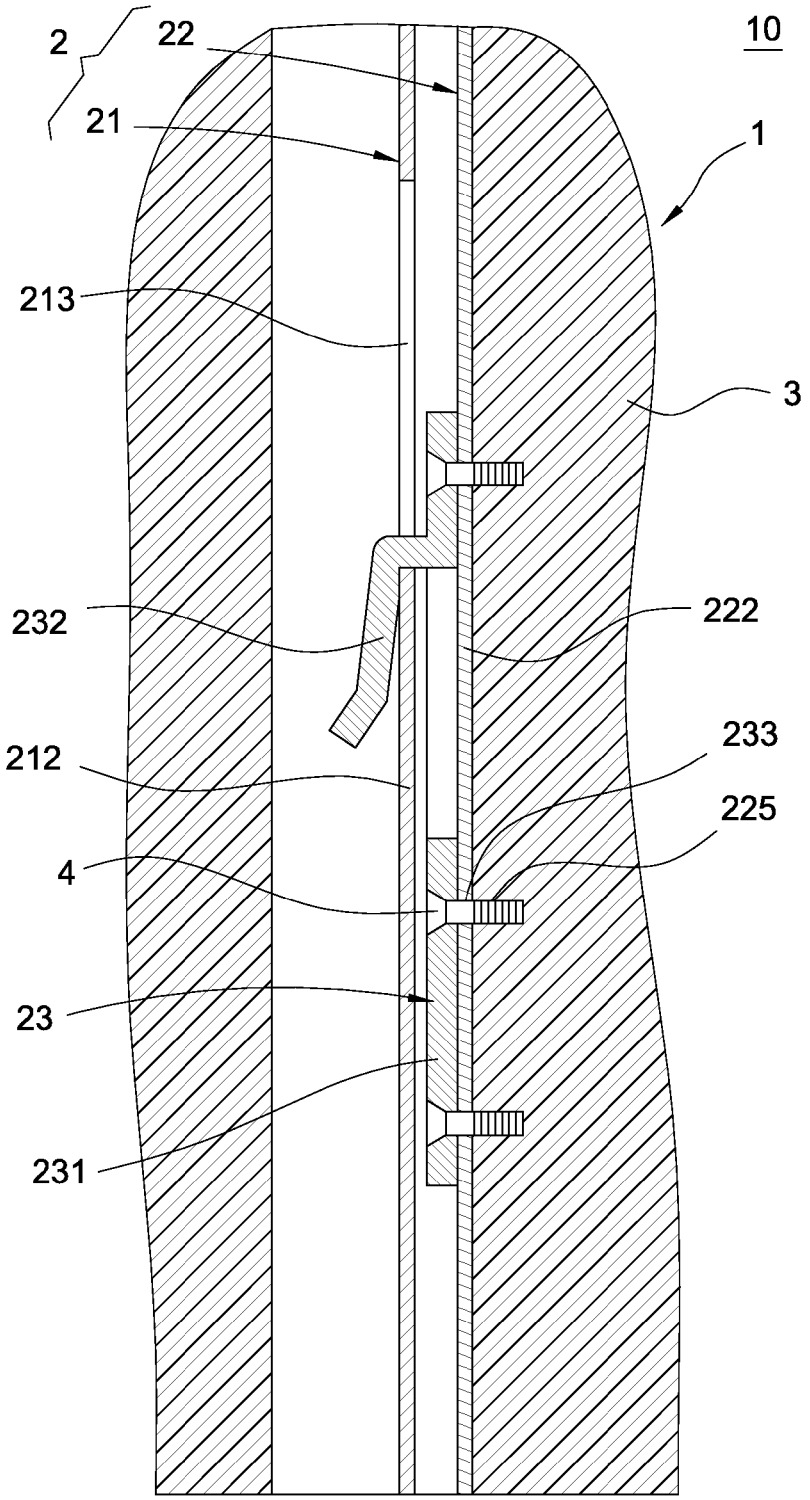

In the partition structure 10 of the present invention, each of the partition members 1 has the edge 11 formed on the side thereof. The engaging assembly 2 includes the first engaging member 21, the second engaging member 22 and the locking member 23. The first engaging member 21 has the first L-shaped wing portions 211 extending from the two sides thereof and the convex portion 212 formed on the middle thereof. The convex portion 212 has the opening slot 213. The second engaging member 22 has the second L-shaped wing portions 221 extending from the two sides thereof and the concave portion 222 formed on the middle thereof. The locking member 23 is fixed to the concave portion 222. Substantially, the first engaging member 21 is fixed to one of the partition members 1, the second engaging member 22 is fixed to the other one of the partition members 1, the first L-shaped wing portions 211 and the second L-shaped wing portions 221 corresponding overlap each of the edges 11, respectively, the convex portion 212 and the concave portion 222 are engaged with each other, the locking member 23 is correspondingly engaged with the opening slot 213. Regarding to the use state of partition structure 10 of the present invention, the first engaging member 21 is fixed to one of the partition members 1, the second engaging member 22 is fixed to the other one of the partition members 1, the first L-shaped wing portions 211 and the second L-shaped wing portions 221 correspondingly overlap each of the edges 11, respectively, the first engaging member 21 and the second engaging member 22 are engaged with each other, such that the convex portion 212 and the concave portion 222 are engaged with each other, the locking member 23 is correspondingly engaged with the opening slot 213. Accordingly, the locking member 23 mounted on the second engaging member 22 is correspondingly engaged with the opening slot 213 of the first engaging member 21, such that positioning between each of the partition members 1 is convenient, quick and accurate. When each of the partition members 1 vibrates due to being accidently crashed or pushed, each of the partition members 1 is not disassembled easily based on engagement of the locking member 23, such that the partition structure 10 has advantages of convenient construction, quick assembly and stable structure. In addition, as illustrated in FIG. 3, the barb 232 is tilted so as to be much more tightly engaged with the opening slot 213 via greater force or weight effect.

Figure 5:
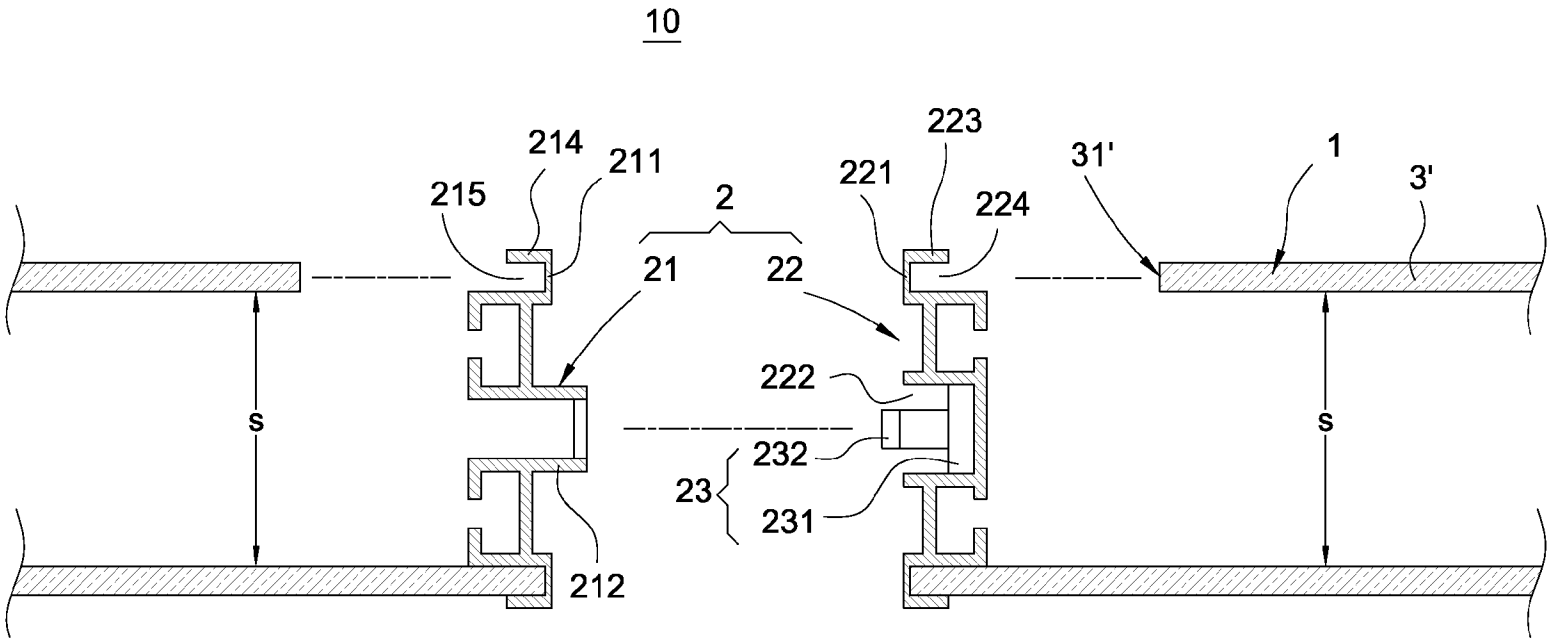
FIG. 5 is a schematically sectional view of the partition structure according to a second embodiment of the present invention.

Please refer to FIG. 5, the partition structure according to a second embodiment of the present invention is illustrated. Substantially, each of the partition members 1 includes two thin boards 3'. Each of the thin boards 3' has a lateral side segment 31'. Each of the lateral side segments 31' forms each of the edges 11. The first engaging member 21 has a first folding segment 214 reversely extending from an end of each of the first L-shaped wing portion 211. A first accommodation slot 215 is formed between each of the first L-shaped wing portions 211 and each of the first folding segment 214. Each of the lateral side segments 31' is inserted in each of the first accommodation slots 215, respectively, such that a separating space s is formed between the two thin boards 3'. The first engaging member 21 is accommodated in the separating space s. The second engaging member 22 has a second folding segment 223 reversely extending from an end of each of the second L-shaped wing portions 221. A second accommodation slot 224 is formed between each of the second L-shaped wing portions 221 and each of the second folding segments 223. Each of the lateral side segments 31' is inserted in each of the second accommodation slots 224, respectively, such that a separating space s is formed between the two thin boards 3'. The second engaging member 22 is accommodated in the separating space s.

Accordingly, the first engaging member 21 has the two first L-shaped wing portions 211 extending from the two sides thereof, the second engaging member 22 has the two second L-shaped wing portions 221 extending from the two sides thereof, each of the partition members 1 being the solid board 3 or the thin board 3' can contact the first L-shaped wing portions 211 and the second L-shaped wing portions 221 such that the first engaging member 21 and the engaging member 22 can be engaged with the solid board 3 or the thin board 3' at least via the first L-shaped wing portion 211 and the second L-shaped wing portion 221, so as to improve the application of the engaging assembly 2 to the partition members 1 and the widespread of the engaging assembly 2.

Figure 4:
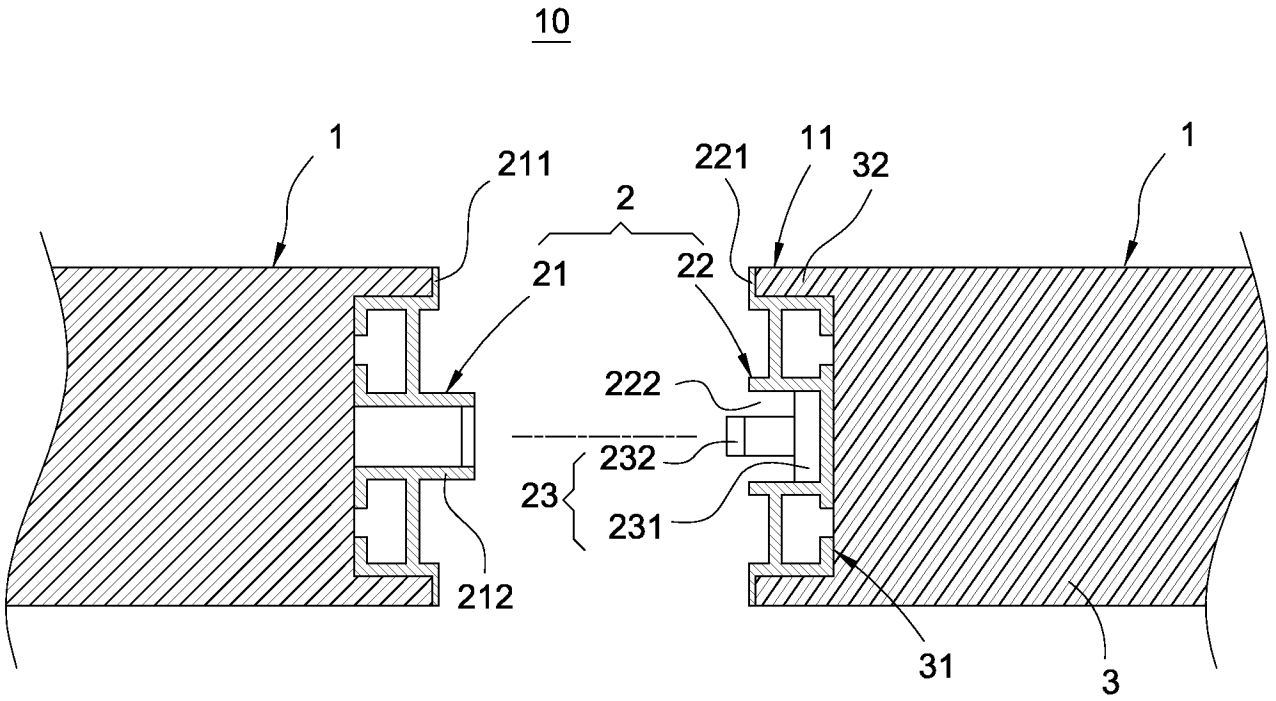
FIG. 4 is another schematically sectional view of the partition structure according to the first embodiment of the present invention.

The detailed description is as follows. As illustrated in FIG. 4, when each of the partition members 1 is a solid board 3, since the solid board 3 has a large contacting area, the first engaging member 21 and the second engaging member 22 can has via holes 24 anywhere, such as on the convex portion 212, the concave portion 222, the first L-shaped wing portions 211 and the second L-shaped wing portions 221, such that the fastening member 4 fastens the first engaging member 21 and the second engaging member 22 on the solid board 3 via the via hole 24 subsequently.

As illustrated in FIG. 5, when each of the partition members 1 includes two thin boards 3', since the thin board 3' has small contacting area, the first engaging member 21 and the second engaging member 22 merely can have fastening holes on the first L-shaped wing portion 211 and the second L-shaped wing portion 221, so as to sequentially provide for the fastening members to fasten the first engaging member 21 and the second engaging member 22 on the thin board 3' via the fastening hole. Alternatively, the first engaging member 21 has the first folding segment 214 reversely extending from the end of each of the first L-shaped wing portions 211, the first accommodation slot 215 is formed between each of the first L-shaped wing portions 211 and each of the first folding segments 214, each of the thin boards 3' is inserted in each of the first accommodation slots 215, respectively, second engaging member 22 has second folding segment 223 reversely extending from the end of each of the second L-shaped wing portions 221, second accommodation slot 224 is formed between each of the second L-shaped wing portions 221 and each of the second folding segments 223, and each of the thin boards 3' is inserted in each of the second accommodation slots 224, respectively.

Figure 6:
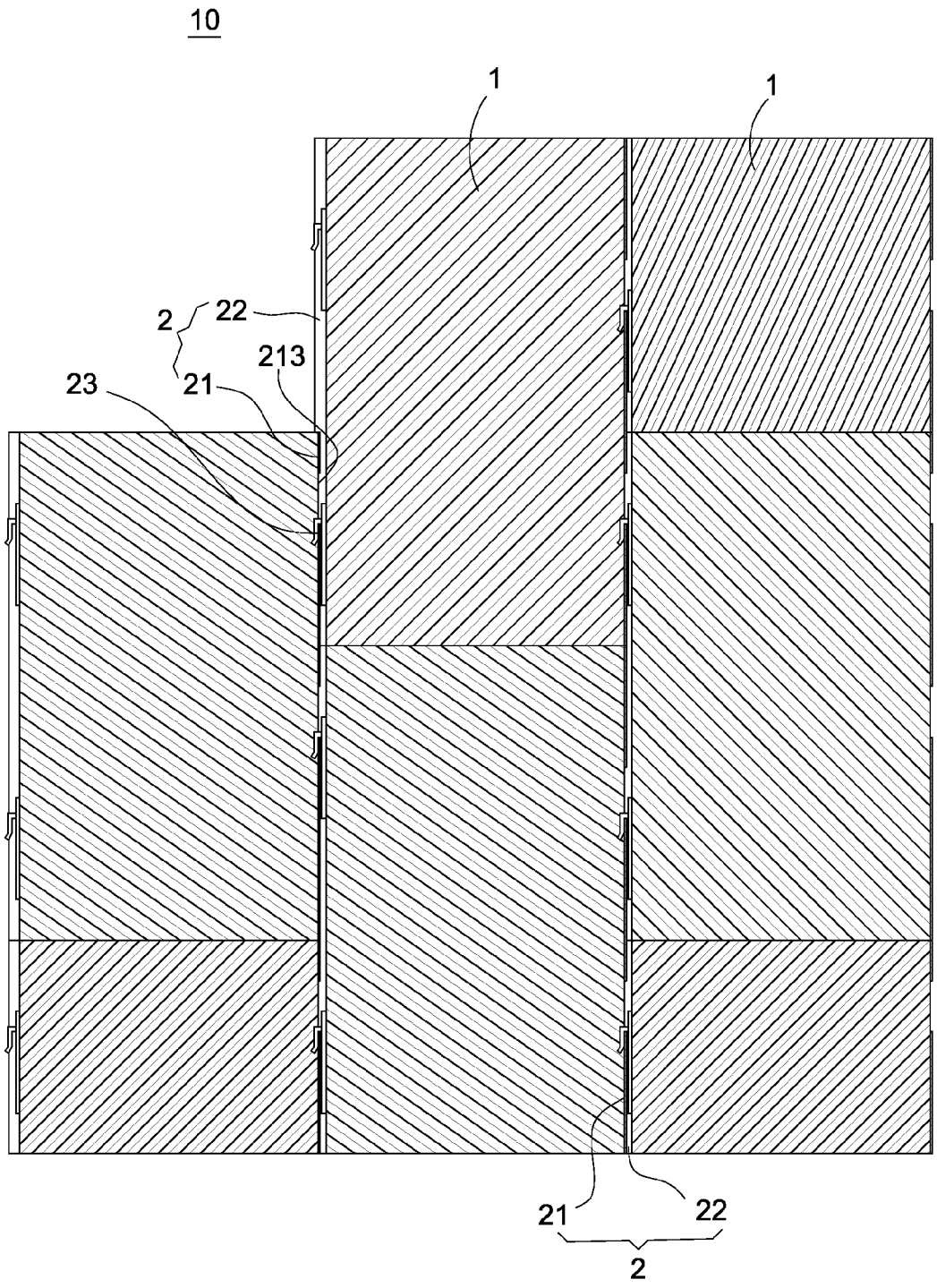
FIG. 6 is a schematically assembly view of the partition structure according to a third embodiment of the present invention.

Please refer to FIG. 6, the partition structure according to a third embodiment of the present invention is illustrated. Substantially, the partition member 1 and the engaging assembly 2 include a plurality of partition members 1 and engaging assemblies 2. Each of the engaging assemblies 2 has a plurality of locking members 23 and opening slots 213. Each of the partition members 1 can be interlace with each other via each of the engaging assemblies 2. The two locking members 23 of the second engaging member 22 can be engaged with the two opening slots 213 of the two first engaging members 21, respectively, such that interlacement of each of the partition members 1 enhances mutual connection.

Figure 7:
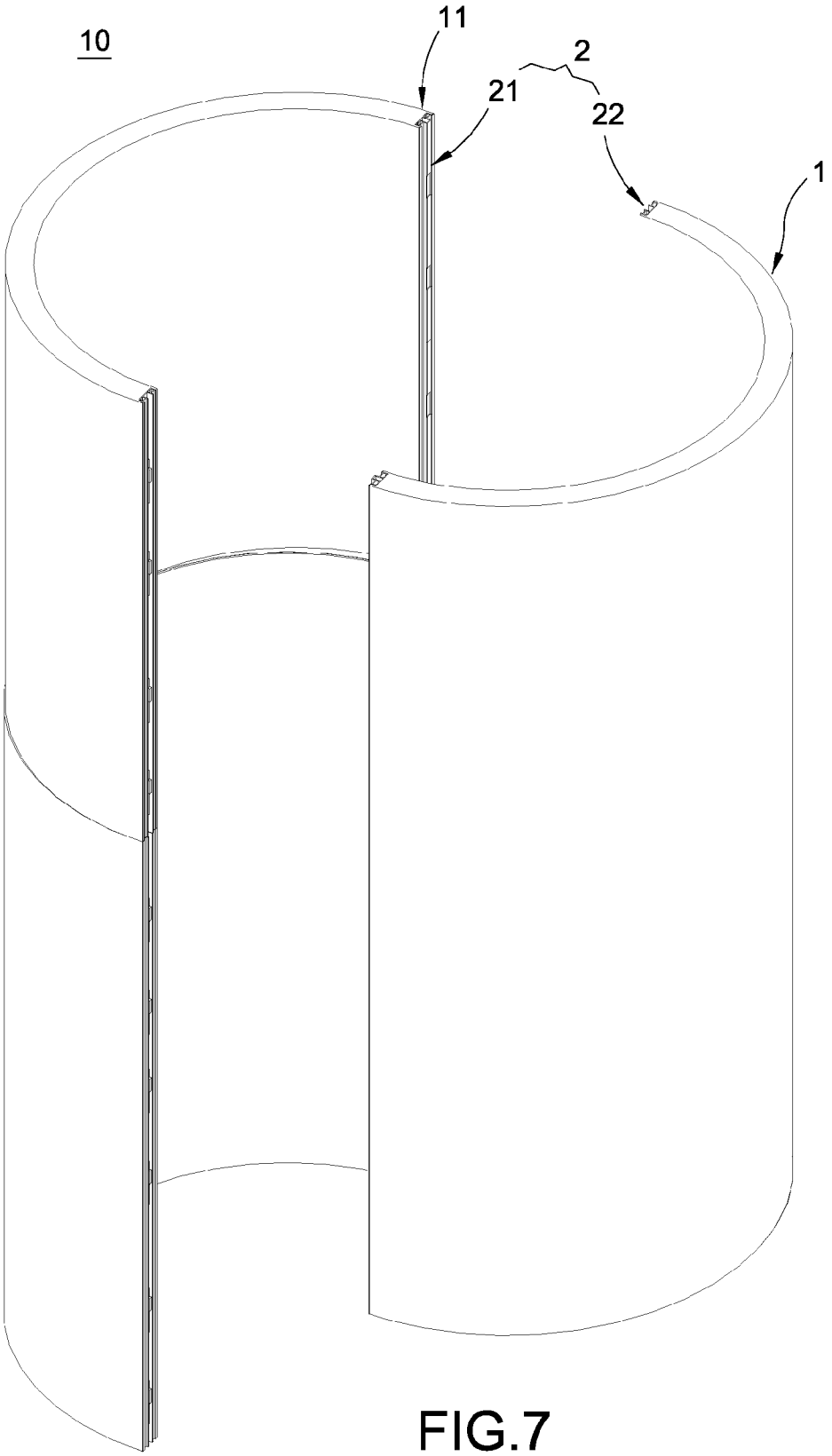
FIG. 7 is a schematically assembly view of the partition structure according to a fourth embodiment of the present invention.

Please refer to FIG. 7, the partition structure of a fourth embodiment of the present invention is illustrated. Substantially, as illustrated in FIGS. 1-6, the partition member 1 is a rectangular board or a semi-arc board. Therefore, the partition member 1 can be circular, arc or of other shape, but not limited to this embodiment.

Figure 8:
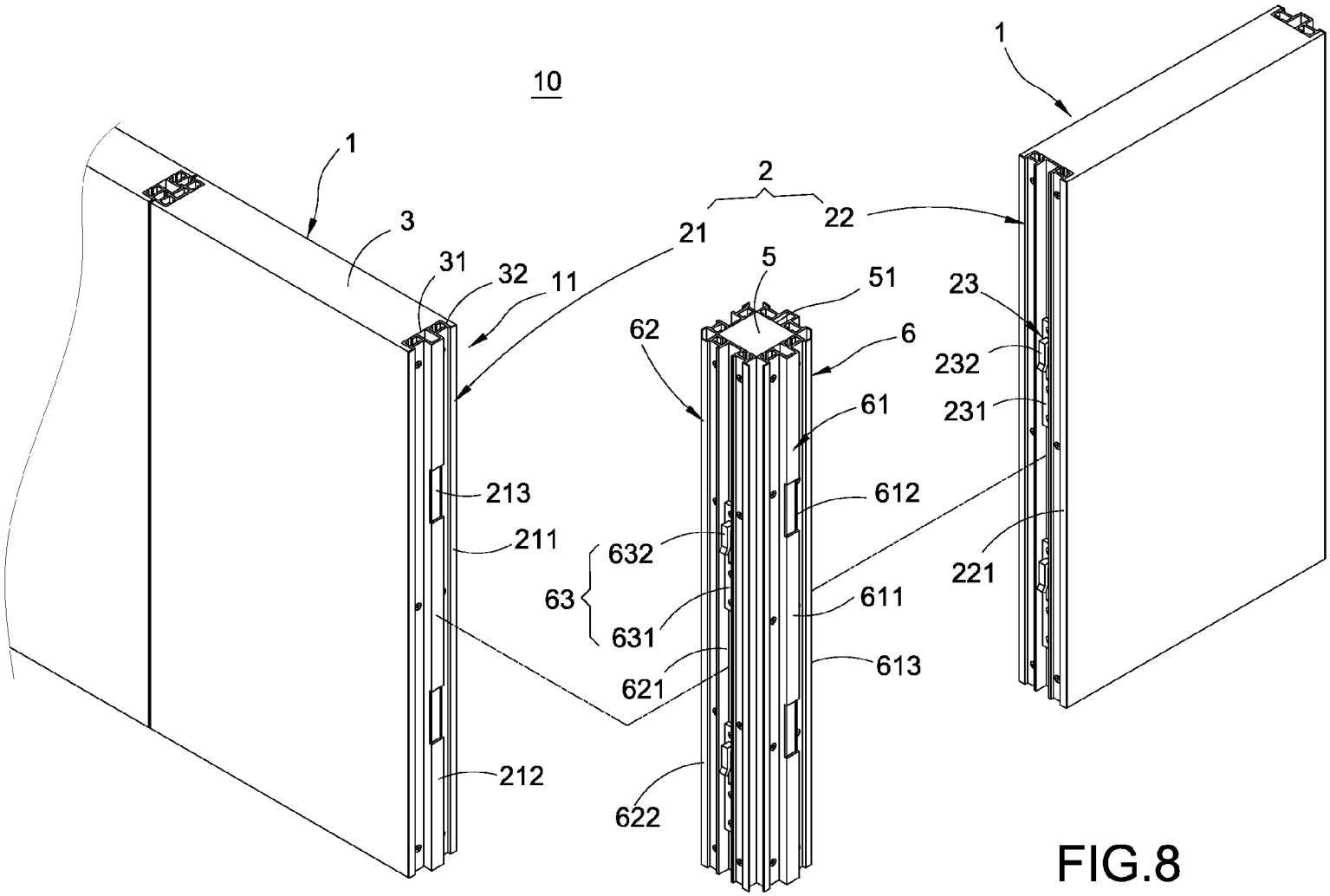
FIG. 8 is a perspective explosion view of the partition structure according to a fifth embodiment of the present invention.

Please refer to FIG. 8, the partition structure of a fifth embodiment of the present invention is illustrated. The partition structure 10 primarily comprises two partition members 1, an engaging assembly 2, a column body 5 and a butting assembly 6.

The column body 5 has at least two lateral surfaces 51 formed on a periphery thereof.

The butting assembly 6 includes a first butting member 61, a second butting member 62 and at least one auxiliary locking member 63 The first butting member 61 has a projection portion 611 formed on a middle thereof. The projection portion 611 has at least one penetrating slot 612. The second butting member 62 has a cavity portion 621 formed on a middle thereof. The auxiliary locking member 63 is fixed to the cavity portion 621.

Substantially, the first engaging member 21 is fixed to one of the partition members 1, the second engaging member 22 is fixed to the other one of the partition members 1, the two first L-shaped wing portion 211 and the two second L-shaped wing portion 221 correspondingly overlap each of the two edges 11, respectively, the first butting member 61 and the second butting member 62 are fixed to each of the lateral surfaces 51, respectively, the convex portion 212 and the cavity portion 621 are engaged with each other, the auxiliary locking member 63 is correspondingly engaged with the opening slot 213, the projection portion 611 and the concave portion 222 are engaged with each other, and the locking member 23 is correspondingly engaged with penetrating slot 612.

The detailed description is as follows. The locking member 23 has a main body 231 and a barb 232 extending from the main body 231. The barb 232 is inserted in the penetrating slot 612 and engaged to the projection portion 611 with each other. The auxiliary locking member 63 has a base body 631 and a hook 632 extending from the base body 631. The hook 632 is inserted in the opening slot 213 and engaged to the convex portion 212 with each other.

Accordingly, the engaging arrangement between each of the partition members 1 can be not only of "–"-shaped but also of L, T, V-shaped by engaging the column body 5 and butting assembly 6, so as to vary the assembly of the partition structure 10.

In addition, the first butting member 61 has two first L-shaped wing sheets 613 extending from two sides thereof, the second butting member 62 has two second L-shaped wing sheets 622 extending from two sides thereof, the two first L-shaped wing sheets 613 and the two second L-shaped wing portions 221 contact with each other, the two second L-shaped wing sheets 622 and the two first L-shaped wing portions 211 contact each other, such that the first L-shaped wing portions 211, the second L-shaped wing portions 221, the first L-shaped wing sheets 613 and the second L-shaped wing sheets 622 collectively cover the connecting location between the engaging assembly 2 and the butting assembly 6, such that the partition structure 10 of the present invention is simple and beautiful.

Figure 9:
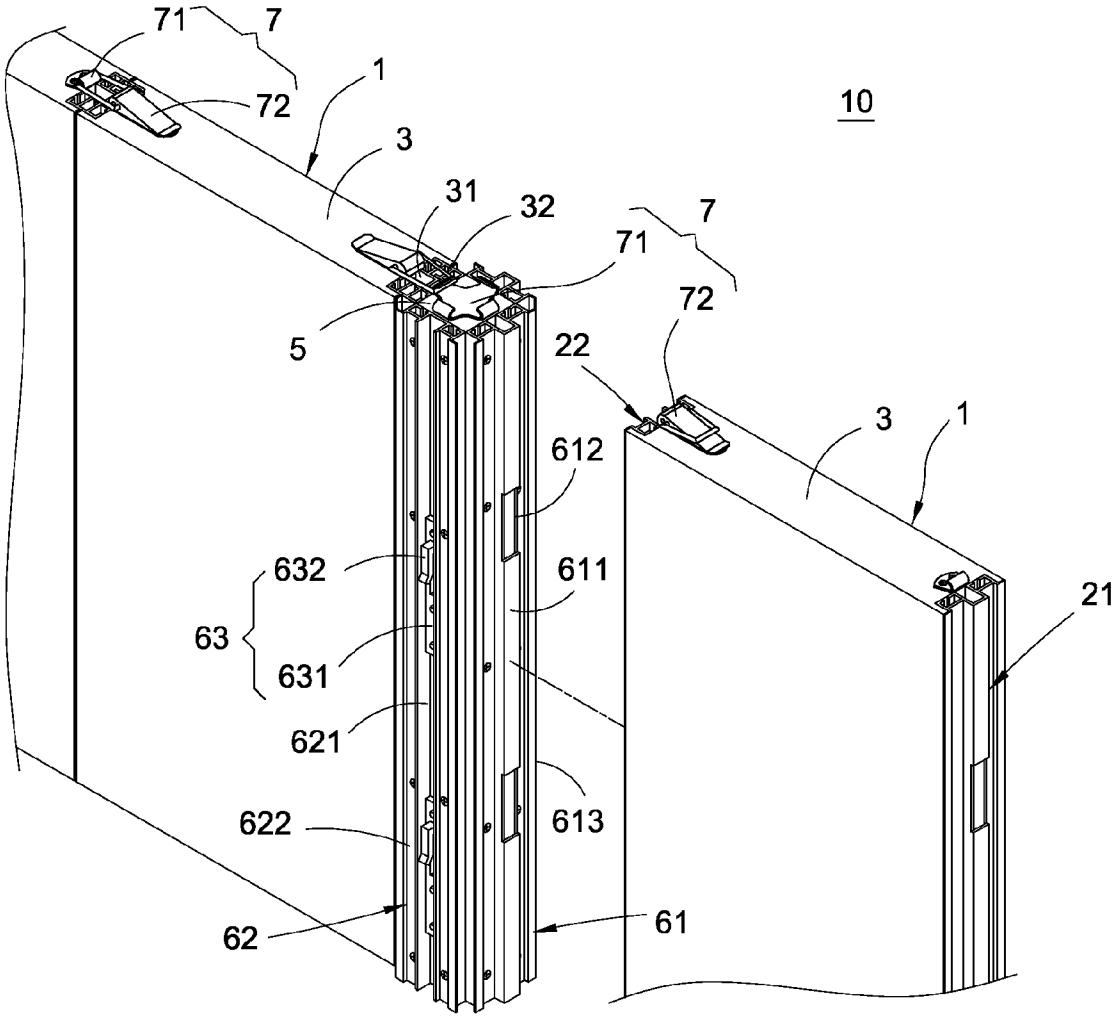
FIG. 9 is a perspective explosion view of the partition structure according to a sixth embodiment of the present invention.

Please refer to FIG. 9, the partition structure of a sixth embodiment of the present invention is illustrated. Substantially, the partition structure 10 further comprises one or more latch mechanisms 7. The latch mechanism 7 comprises a first latch member 71 and a second latch member 72 correspondingly engaged with the first latch member 71. The first latch member 71 is fixed to one of the partition members 1. The second latch member 72 is fixed to the other one of the partition members 1. Alternatively, the first latch member 71 is fixed to the column body 5, and the second latch member 72 is fixed to one of the partition members 1. Accordingly, each of the partition members 1 and the column body 5 are engaged with each other via the latch mechanism 7, such that each of the partition members 1 and the column body 5 are connected together much steadily.

In conclusion, the partition structure having the engaging assembly according to the present invention indeed achieve the purpose and thus solves the defect of the prior art. Further, it totally complies with requirements for the application of a Utility Model patent extremely based on the novelty and non-obviousness thereof such that an application is filed pursuant to the Patent Law. Applicant respectfully requests an examination for the application so as to protect the invention of the inventor.

What is claimed is:

1. A partition structure comprising:

two partition members, each of the partition members having two edges on a side thereof; and an engaging assembly including a first engaging member, a second engaging member and at least one locking member, the first engaging member having two first L-shaped wing portions extending from two sides thereof and a convex portion formed between the two first L-shaped wing portions, the convex portion having at least one opening slot, the second engaging member having two second L-shaped wing portions extending from two sides thereof and a concave portion formed between the two second L-shaped wing portions and having a bottom surface, the locking member being fixed to the bottom surface of the concave portion;

a plurality of fastening members, the second engaging member having a plurality of orifice holes formed on the concave portion, the main body having a plurality of through holes, each of the fastening members being inserted in and fixed to each of the through holes and each of the orifice holes, respectively wherein the first engaging member is fixed to one of the partition members, the second engaging member is fixed to the other one of the partition members, the two first L-shaped wing portions and the two second L-shaped wing portions correspondingly overlap the two edges of each of the partition members, respectively, the convex portion is accommodated into the concave portion and the locking member is correspondingly engaged with the opening slot, wherein the locking member has a main body and a barb extending from the main body, and the barb is inserted in the opening slot and engaged to the convex portion.

2. The partition structure according to claim 1, wherein each of the partition members is a solid board, the solid board has a concave segment formed on a lateral surface thereof and two convex bars formed with respect to two sides of the concave segment, the two convex bars form the two edges, and the first engaging member and the second engaging member are accommodated in each of the concave segments, respectively.

3. The partition structure according to claim 2, further comprising a plurality of fastening members, the first engaging member and the second engaging member having a plurality of first perforating holes, respectively, the solid board having a plurality of second perforating holes, each of the fastening members being inserted in and fixed to each of the first perforating holes and each of the second perforating holes, respectively.

4. The partition structure according to claim 1, wherein each of the partition members, includes two thin boards, each of the thin boards has a lateral side segment, and each of the lateral side segments forms each of the edges.

5. The partition structure according to claim 4, wherein the first engaging member has a first folding segment reversely extending from an end of each of the first L-shaped wing portions, a first accommodation slot is formed between each of the first L-shaped wing portions and each of the first folding segments, each of the lateral side segments is inserted in each of the first accommodation slots, respectively, such that a separating space is formed between the two thin boards, and the first engaging member is accommodated in the separating space.

6. The partition structure according to claim 4, wherein the second engaging member has a second folding segment reversely extending from an end of each of the second L-shaped wing portions, a second accommodation slot is formed between each of the second L-shaped wing portions and each of the second folding segments, each of the lateral side segments is inserted in each of the second accommodation slots, respectively, such that a separating space is formed between the two thin boards, and the second engaging member is accommodated in the separating space.

7. The partition structure according to claim 1, further comprising a latch mechanism, the latch mechanism comprising a first latch member and a second latch member correspondingly engaged with the first latch member, the first latch member being fixed to one of the partition members, the second latch member being fixed to the other one of the partition members.

8. The partition structure according to claim 1, wherein the partition members includes a plurality of partition members, the engaging assembly includes a plurality of engaging assemblies, the locking member of each of the engaging assemblies includes a plurality of locking members, the opening slot of each of the engaging assemblies includes a plurality of opening slots, and the partition members are interlaced with each other via the engaging assemblies.

* * * * *